US010358952B2

(12) United States Patent
Nielsen

(10) Patent No.: US 10,358,952 B2
(45) Date of Patent: Jul. 23, 2019

(54) HYDRAULIC LASH ADJUSTER

(71) Applicant: Eaton Corporation, Cleveland, OH (US)

(72) Inventor: Douglas J. Nielsen, Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 135 days.

(21) Appl. No.: 15/583,069

(22) Filed: May 1, 2017

(65) Prior Publication Data

US 2017/0234173 A1 Aug. 17, 2017

Related U.S. Application Data

(63) Continuation of application No. PCT/US2015/058336, filed on Oct. 30, 2015.

(60) Provisional application No. 62/072,480, filed on Oct. 30, 2014.

(51) Int. Cl.
*F01L 1/14* (2006.01)
*F01L 1/24* (2006.01)

(52) U.S. Cl.
CPC ..... *F01L 1/24* (2013.01); *F01L 2001/2427* (2013.01); *F01L 2001/2433* (2013.01); *F01L 2001/2444* (2013.01)

(58) Field of Classification Search
CPC ... F01L 1/24; F01L 2001/2427; F01L 1/2433; F01L 2001/2444
USPC ..... 123/90.48, 90.52, 90.55
See application file for complete search history.

(56) References Cited

U.S. PATENT DOCUMENTS

| | | | | |
|---|---|---|---|---|
| 2,667,149 | A | 1/1954 | Purchas et al. | |
| 2,688,319 | A | 9/1954 | Humphreys | |
| 4,840,153 | A | 6/1989 | Aida et al. | |
| 6,325,034 | B1 * | 12/2001 | Edelmayer | F01L 1/2405 123/90.36 |
| 6,651,779 | B2 * | 11/2003 | Cecur | F01L 1/14 123/90.35 |
| 7,246,584 | B2 | 7/2007 | Geiger et al. | |
| 7,921,823 | B2 | 4/2011 | Sailer et al. | |
| 2004/0074463 | A1 | 4/2004 | Mandal et al. | |
| 2006/0169236 | A1 | 8/2006 | Karbstein et al. | |

(Continued)

FOREIGN PATENT DOCUMENTS

| | | | | |
|---|---|---|---|---|
| EP | 1186751 | A1 | 3/2002 | |
| WO | WO-2014123755 | A2 * | 8/2014 | F01L 1/24 |

OTHER PUBLICATIONS

International Search Report and Written Opinion for International Application No. PCT/US2015/058336 dated Dec. 21, 2015, 12 pages.

(Continued)

*Primary Examiner* — Ching Chang
(74) *Attorney, Agent, or Firm* — RMCK Law Group PLC

(57) ABSTRACT

A hydraulic lash adjuster assembly constructed in accordance to one example of the present disclosure includes a bucket and a hydraulic lash adjuster. The hydraulic lash adjuster is received in the bucket and has a body, a leakdown plunger and a socket. The leakdown plunger is received in the body. The socket is received by the leakdown plunger. The socket and leakdown plunger define a reservoir therebetween. The socket includes a gravity feed arrangement to feed fluid to the reservoir of the leakdown plunger.

18 Claims, 6 Drawing Sheets

(56) References Cited

U.S. PATENT DOCUMENTS

2012/0325171 A1 12/2012 Langewisch et al.

OTHER PUBLICATIONS

EP Search Report for EP Application No. 15854227 dated May 25, 2018, 7 pages.

* cited by examiner

HYDRAULIC LASH ADJUSTER

CROSS-REFERENCE TO RELATED APPLICATIONS

This application is a continuation of International Application No. PCT/US2015/058336 filed Oct. 20, 2015, which claims the benefit of U.S. patent application Ser. No. 62/072,480 filed on Oct. 30, 2014. The disclosure of the above application is incorporated herein by reference.

FIELD

The present disclosure is directed to a hydraulic or mechanical lash adjuster.

BACKGROUND

Hydraulic or mechanical lash adjusters for internal combustion engines have been in use for many years to eliminate clearance or lash between engine valve train components under varying operating conditions. Lash adjusters can maintain efficiency and reduce noise and wear in the valve train. In some examples, hydraulic lash adjusters can support the transfer of energy from the valve-actuating cam to the valves through hydraulic fluid trapped in a pressure chamber under the plunger.

The background description provided herein is for the purpose of generally presenting the context of the disclosure. Work of the presently named Inventor, to the extent it is described in this background section, as well as aspects of the description that may not otherwise qualify as prior art at the time of filing, are neither expressly nor impliedly admitted as prior art against the present disclosure.

SUMMARY

A hydraulic lash adjuster assembly constructed in accordance to one example of the present disclosure includes a bucket and a hydraulic lash adjuster. The hydraulic lash adjuster is received in the bucket and has a body, a leakdown plunger and a socket. The leakdown plunger is received in the body. The socket is received by the leakdown plunger. The socket and leakdown plunger define a reservoir therebetween. The socket includes a gravity feed arrangement to feed fluid to the reservoir of the leakdown plunger.

According to other features, the socket comprises a top surface, a bottom surface and an intermediate shoulder surface. The intermediate shoulder surface abuts the leakdown plunger. The gravity feed arrangement comprises at least one aperture defined through the socket. The at least one aperture comprises a first pair of apertures that lead to a second pair of apertures. The apertures of the second pair of apertures are offset from the apertures of the first pair. The second pair of apertures provide a surface tension seal to the top surface of the leakdown plunger and route fluid into the reservoir.

According to additional feature, the leakdown plunger defines a recirculation passageway including an annular notch portion and an aperture portion. The socket can be enclosed in the bucket. A push tube guide can enclose the socket within the bucket.

A hydraulic lash adjuster assembly constructed in accordance to other features of the present disclosure can include a bucket and a hydraulic lash adjuster received in the bucket. The hydraulic lash adjuster can have a body, a leakdown plunger and a socket assembly. The leakdown plunger can be received in the body. The socket assembly can be received by the leakdown plunger. The socket assembly and leakdown plunger can define a reservoir therebetween. The socket assembly can include a socket and a valve member. The socket can include a valve seat and a valve restraint. The valve member can move relative to the socket. The valve member can engage the valve restraint in a first orientation and engage the valve seat in a second orientation. Fluid is permitted to flow between the valve member and the valve restraint in the first orientation. Fluid is precluded from flowing between the valve member and the valve seat in the second orientation.

According to other features, the valve member can comprise a plate. The valve member can be captured in the socket by the valve restraint. The valve restraint can include a shelf. In one configuration the shelf can be non-flat. In another configuration the shelf can be irregular shaped. In an alternate configuration the valve restraint comprises fingers. The fingers can be radially offset relative to each other.

A hydraulic lash adjuster assembly constructed in accordance to other features of the present disclosure can include a hydraulic lash adjuster having a body, a leakdown plunger and a socket assembly. The leakdown plunger can be received in the body. The socket assembly can be received by the leakdown plunger. The socket assembly and leakdown plunger can define a reservoir therebetween. The socket assembly can include a socket and a valve member. The socket can include a valve seat and a valve restraint. The valve member can be captured by a valve restraint mounted in the socket. The valve member can move relative to the socket. The valve member can engage the valve restraint in a first orientation and engage the valve seat in a second orientation. Fluid is permitted to flow between the valve member and the valve restraint in the first orientation. Fluid is precluded from flowing between the valve member and the valve seat in the second orientation.

According to other features the hydraulic lash adjuster can further include a bucket. The hydraulic lash adjuster can be received in the bucket. The valve member can comprise a ball. The valve restraint can comprise a cage. The cage can define passages therein.

BRIEF DESCRIPTION OF THE DRAWINGS

The present disclosure will become more fully understood from the detailed description and the accompanying drawings, wherein.

DETAILED DESCRIPTION

Figure 1:
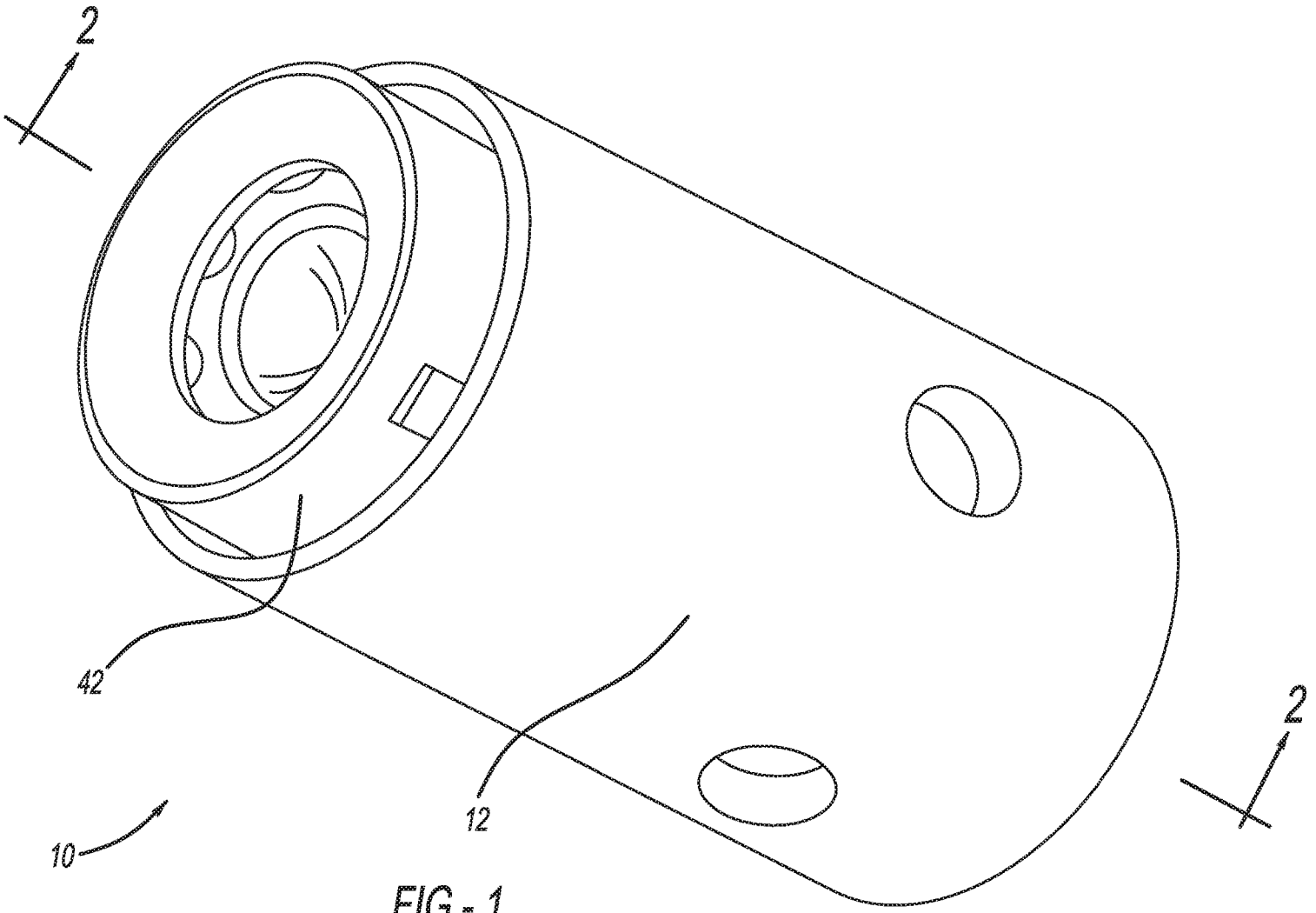
FIG. 1 is a perspective view of a hydraulic lash adjuster constructed in accordance to one example of the present disclosure.

A plurality of different examples of the present teachings is shown in the Figures of the application. Similar features are shown in the various aspects of the present disclosure. Similar features have been numbered with a common reference numeral and have been differentiated by an alphabetic suffix. Also, to enhance consistency, the structures in any particular drawing share the same alphabetic suffix even if a particular feature is shown in less than all of the disclosed aspects of the present teachings. Similar features are structured similarly, operate similarly, and/or have the same function unless otherwise indicated by the drawings or this specification. Furthermore, particular features of one example can replace corresponding features in another example or can supplement other examples unless otherwise indicated by the drawings or this specification.

In some operating environments, it may be desirable to install hydraulic lash adjusters into a dry engine block and in subsequent assembly operations invert the engine for an extended period. In existing hydraulic lash adjusters, at least some of the oil in a reservoir of the hydraulic lash adjuster would leak out. Further, once the engine is fully assembled and started, the high pressure chamber may ingest the air from the reservoir and several minutes (twenty or more) may pass before the high pressure chamber refills with oil. Using a biased, normally-open check valve would allow quicker filling as the normally-open valve arrangement pumps up more quickly than a normally-closed arrangement.

Figure 2:
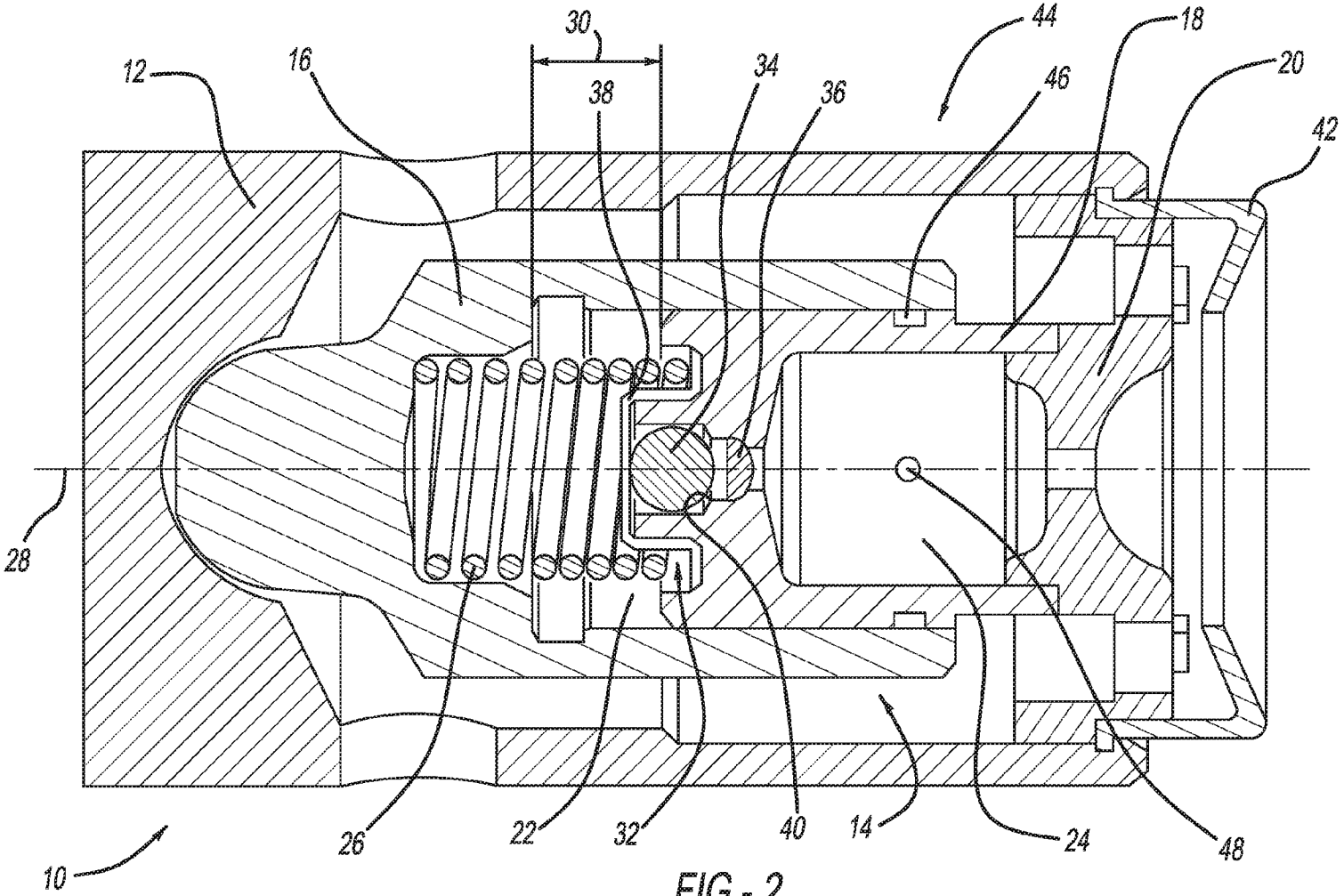
FIG. 2 is a cross-sectional view taken through section lines 2-2 in FIG. 1.
Figure 3:
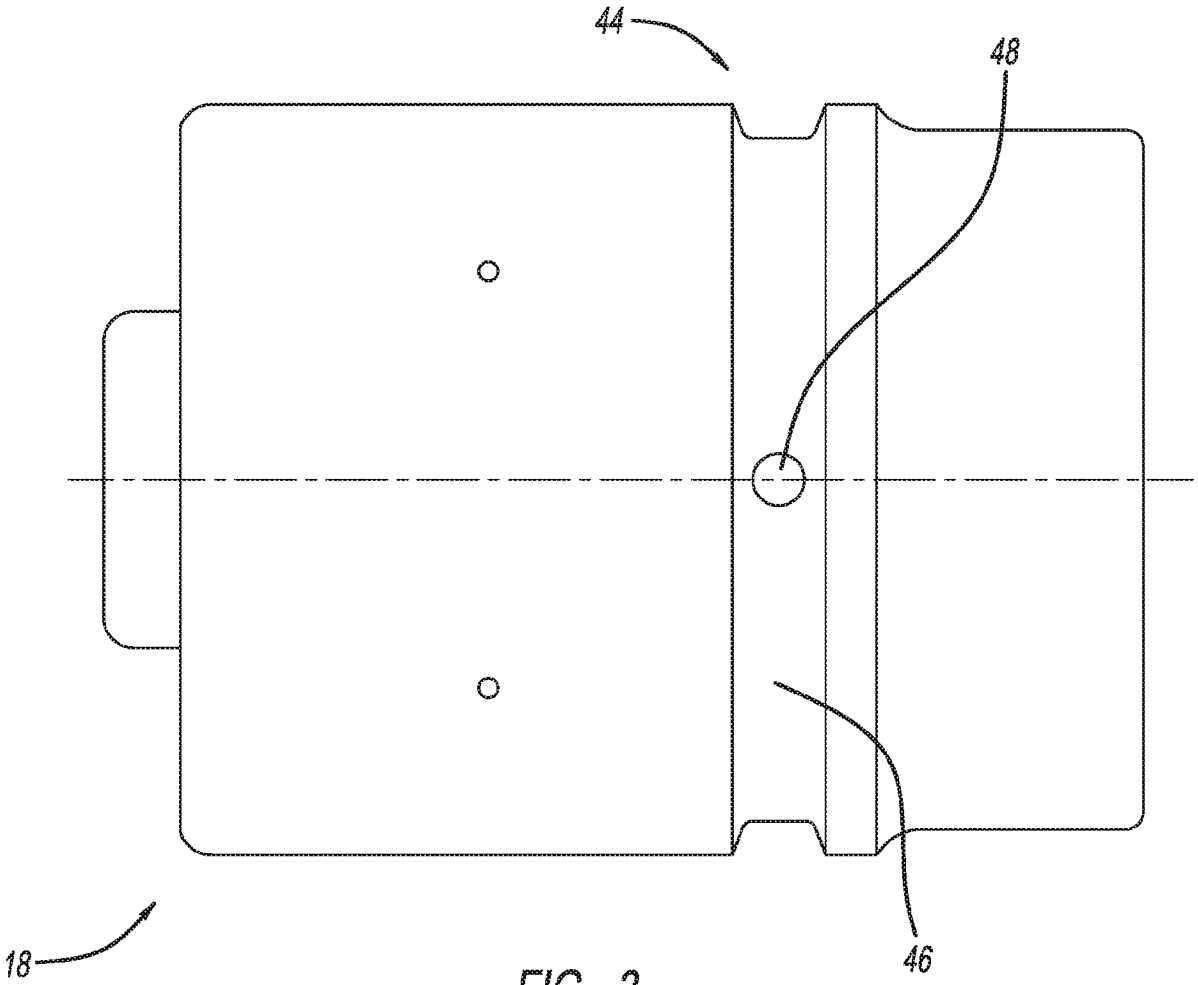
FIG. 3 is a side view of a leakdown plunger of a hydraulic lash adjuster constructed in accordance to one example of the present disclosure.
Figure 4:
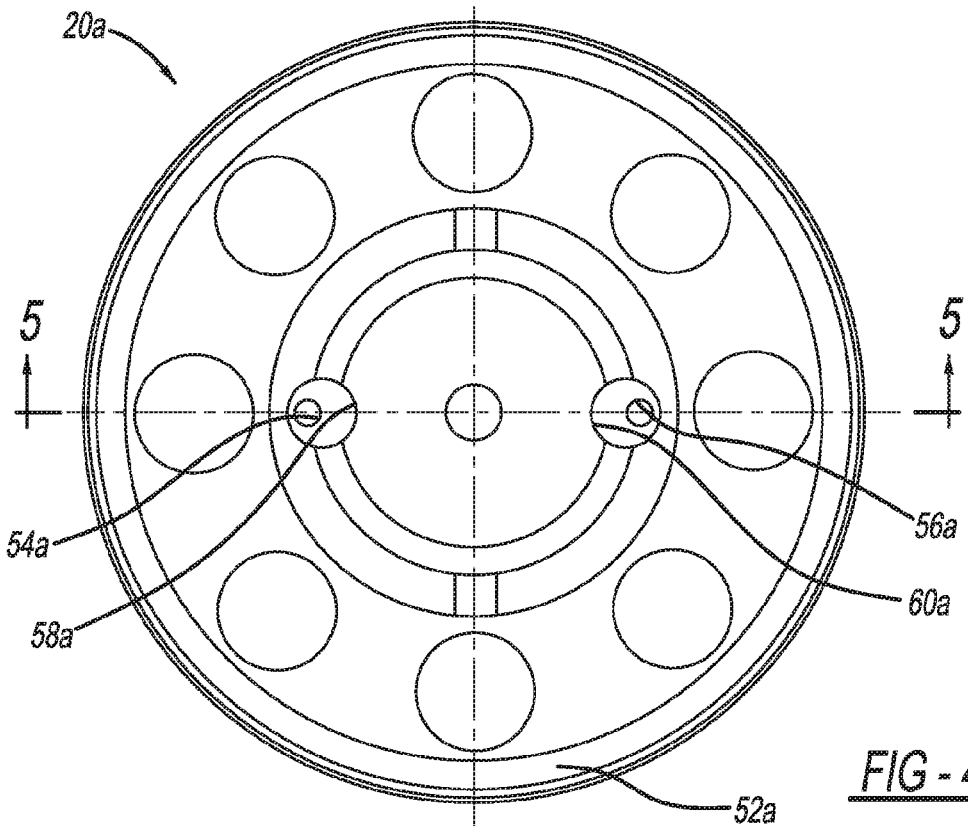
FIG. 4 is bottom view of a socket of a hydraulic lash adjuster constructed in accordance to one example of the present disclosure.

The normally-open valve arrangement also allows for shipping the hydraulic lash adjuster with the reservoir empty. Since the normally-open valve arrangement dispels an amount of fluid or air with each stroke, it allows for shipping the hydraulic lash adjuster with the reservoir empty. Any air that is ingested to the high pressure chamber will more naturally be pumped out with far fewer strokes. It will be appreciated in light of the disclosure that it can be shown that this phenomenon can be optimized by placing the normally open check valve as high in the high pressure chamber as possible. FIGS. 1-3 illustrate a hydraulic lash adjuster having a recirculation passageway to allow for passage of fluid from a high pressure chamber to the reservoir to more quickly fill the reservoir.

Referring now to FIGS. 1-4, a hydraulic lash adjuster assembly 10 can include a bucket 12 and a hydraulic lash adjuster 14. The hydraulic lash adjuster 14 can be received in the bucket 12. The hydraulic lash adjuster 14 can include a body 16, a leakdown plunger 18, and socket 20. The leakdown plunger 18 can be received in the body 16. A high pressure chamber 22 can be defined between the body 16 and the leakdown plunger 18. A reservoir 24 can be defined between leak down plunger 18 and the socket 20. The socket 20 can substantially close the reservoir 24 and can itself be enclosed in the bucket 12 with a push tube guide 42 or clip.

A spring 26 can be disposed in the high pressure chamber 22. The spring 26 can bias the body 16 and the leakdown plunger 18 apart along a central axis 28 of the assembly 10. The extent of relative travel between the leakdown plunger 18 and the body 16 is referenced at 30.

A normally-open valve arrangement 32 can be mounted to the leakdown plunger 18. The normally-open valve arrangement 32 can be positioned between the high pressure chamber 22 and the reservoir 24. The normally-open valve arrangement 32 can include a ball or valve member 34, a spring 36, and a retainer 38. The leakdown plunger 18 can define a valve seat 40. The spring 36 can urge the valve member 34 toward the high pressure chamber 22 and against the retainer 38. A predetermined level of differential pressure between high pressure chamber 22 and reservoir 24 can urge the valve member 34 toward the reservoir 24, overcoming the spring 36, and seating the valve member 34 on the valve seat 40.

A recirculation passageway 44 can be defined by the leakdown plunger 18. The recirculation passageway 44 assists the assembly 10 to pump up from dry or spongy more quickly by returning any oil pumped out of the high pressure chamber 22 to the reservoir 24. The recirculation passageway 44 can include an annular notch portion 46 formed in an outer surface of the leakdown plunger 18. The recirculation passageway 44 can also include an aperture portion 48 extending through the leakdown plunger 18. In operation, fluid can pass between the outside surface of the leakdown plunger 18 and an inside surface of the body 16, collect in the annular notch portion 46, and pass into the reservoir 24 through the aperture portion 48. The recirculation passageway 44 allows the assembly 10 to pump up from dry or spongy relatively quickly.

Figure 5:
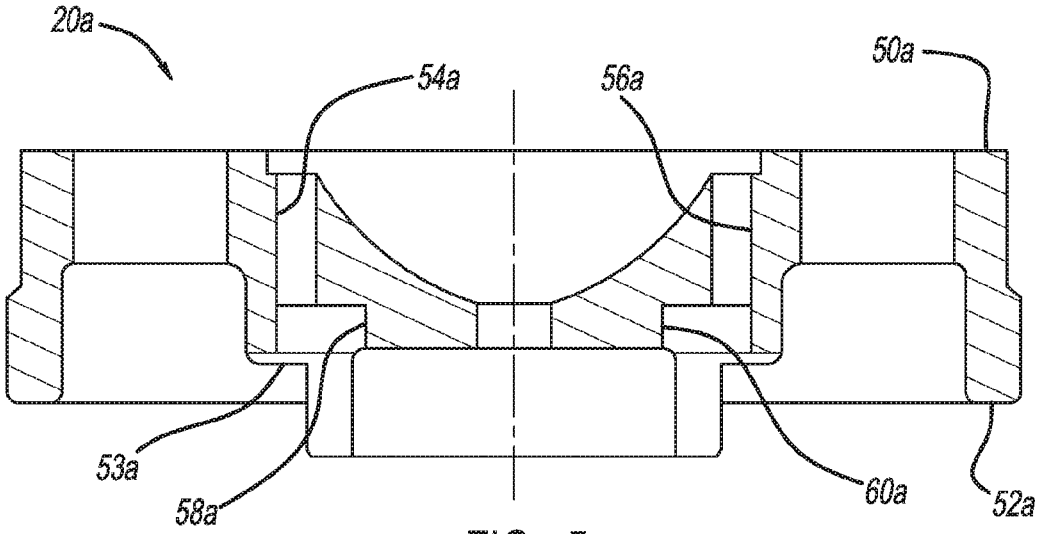
FIG. 5 is a cross-sectional view taken through section lines 5-5 in FIG. 4.

FIG. 5 illustrates an alternative socket 20*a* according to the present disclosure. The socket 20*a* can be incorporated into a hydraulic lash adjuster assembly such as the hydraulic lash adjuster assembly 10 described herein. The socket 20*a* extends between a top surface 50*a*, a bottom surface 52*a* and an intermediate shoulder surface 53*a*. The intermediate shoulder surface 53*a* can abut a leakdown plunger. The socket 20*a* includes a gravity feed arrangement to feed fluid to a reservoir of the leakdown plunger. The gravity feed arrangement includes apertures 54*a*, 56*a*, 58*a*, 60*a*.

Two apertures 54*a* and 56*a* lead to machined apertures 58*a*, 60*a* that are offset to provide a surface tension seal to the top of the leakdown plunger and route fluid into the reservoir. Vent indentations can be defined in the socket 20*a* to vent out any air in the reservoir as fluid fills the reservoir. This would provide a "flow through" design such that any soot or other contaminate would not accumulate. The socket 20*a* depicted in FIGS. 4 and 5 can be a manner to gravity feed oil from the outer diameter of a push tube and/or rocker arm (not shown) down into the reservoir leakdown plunger. The result would be a hydraulic lash adjuster assembly that would not need a pressure feed to it to keep it full, thereby reducing the demand on the oil pump.

Figure 6:
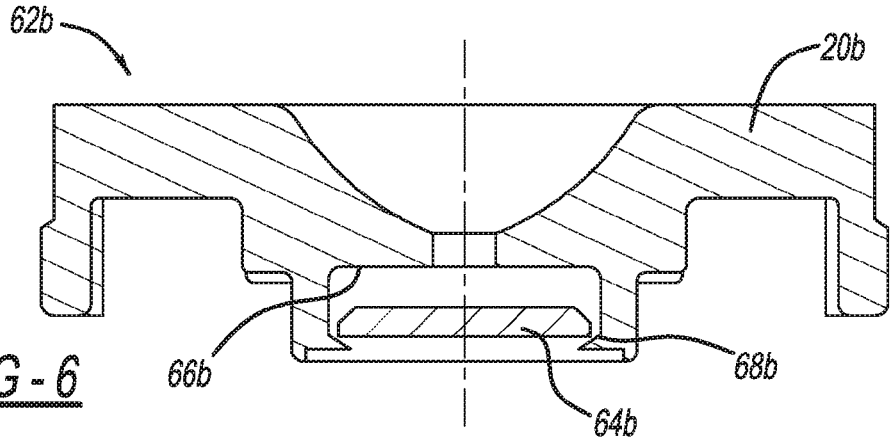
FIG. 6 is a cross-sectional view of a socket assembly with a valve arrangement constructed in accordance to another example of the present disclosure.
Figure 7:
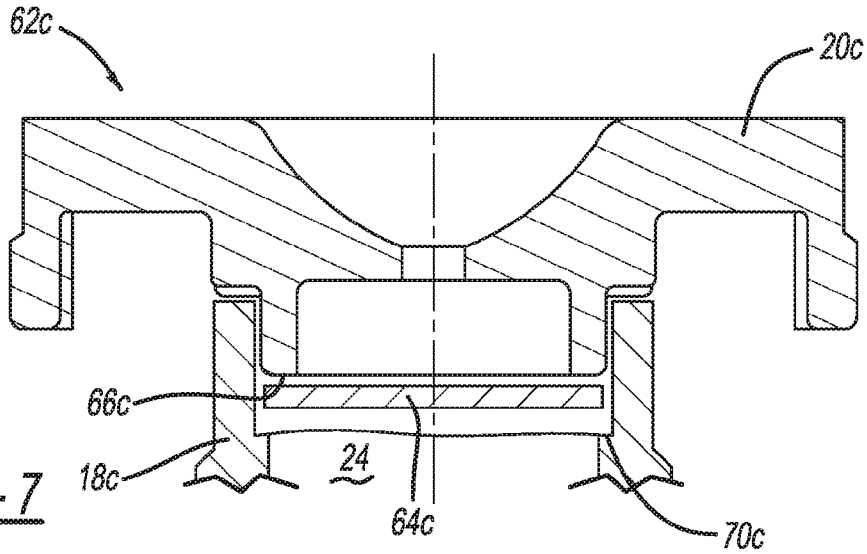
FIG. 7 is a cross-sectional view of a socket assembly with a valve arrangement constructed in accordance to another example of the present disclosure.
Figure 8:
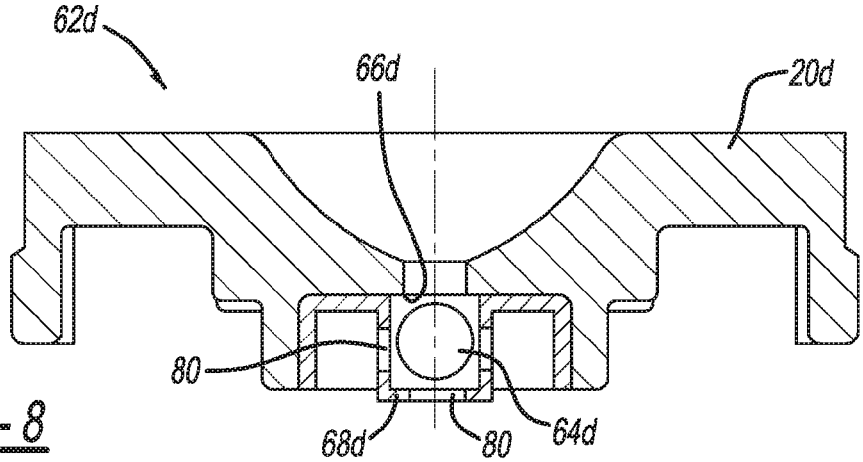
FIG. 8 is a cross-sectional view of a socket assembly with a valve arrangement constructed in accordance to another example of the present disclosure.

FIGS. 6-8 illustrate alternative socket assemblies 62*b*, 62*c*, and 62*d* that can prevent fluid from draining from a reservoir if the engine is inverted for an extended period. As shown in FIG. 6, a socket assembly 62*b* can include a socket 20*b* and a valve member or plate 64*b*. The socket 20*b* can define a valve seat 66*b*. The socket 20*b* can also define a valve restraint or fingers 68*b*. The fingers 68*b* are at least one of radially offset from each other, irregular shape and non-flat. FIG. 6 illustrates the position of the valve member 64*b* when the engine is not inverted. When non-inverted or right side up, fluid is permitted to flow between the plate 64*b* and the fingers 68*b*. Explained further, the irregular shape of the fingers 68*b* does not allow a seal to be achieved between the plate 64*b* and the fingers 68*b*. Other configurations or geometries are contemplated for permitting fluid flow in one direction while inhibiting flow in an opposite direction. The valve member 64*b* can be captured by the valve restraint 68*b*. When the engine is inverted, the valve member 64*b* can be induced by gravity to seat against the valve seat 66*b* and inhibit fluid from escaping the reservoir.

FIG. 7 illustrates a socket assembly 62*c* having a socket 20*c* and a valve member or plate 64*c*. The socket 20*c* can define a valve seat 66*c*. The illustrated position of the valve member 64*c* is between the position when the engine is not inverted and the position when the engine is inverted. The valve member 64*c* can be captured by a valve restraint or shelf 70*c* defined by the leakdown plunger 18*c*. When the engine is inverted, the valve member 64*c* can be induced by gravity to seat against the valve seat 66*c* and prevent fluid from escaping the reservoir 24*c*. When the engine is non-inverted or right side up, fluid is permitted to flow between the plate 64*c* and the shelf 70*c*. Explained further, the irregular or non-flat shape of the shelf 70*c* does not allow a seal to be achieved between the plate 64*c* and the shelf 70*c*.

FIG. 8 illustrates a socket assembly 62*d* having a socket 20*d* and a valve member 64*d*. The socket 20*d* can define a valve seat 66*d*. The valve member 64*d* can be captured by a valve restraint 68*d* mounted on the socket 20*d*. The valve member 64*d* can be a ball. The valve restraint 68*d* can be a cage having passages 80 therethrough. The illustrated position of the valve member 64*d* is between the position when the engine is not inverted and the position when the engine is inverted. When the engine is inverted, the valve member 64*d* can be induced by gravity to seat against the valve seat 66*d* and prevent fluid from escaping the reservoir. When non-inverted or right side up, fluid is permitted to flow around the valve member 64*d* and through the passages 80 in the cage of the valve restraint 68*d*.

Figure 9:
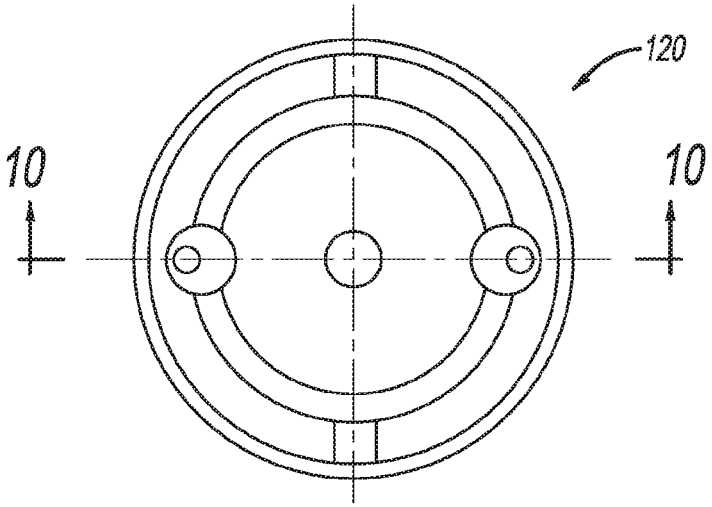
FIG. 9 is bottom view of a socket of a hydraulic lash adjuster constructed in accordance to another example of the present disclosure.
Figure 10:
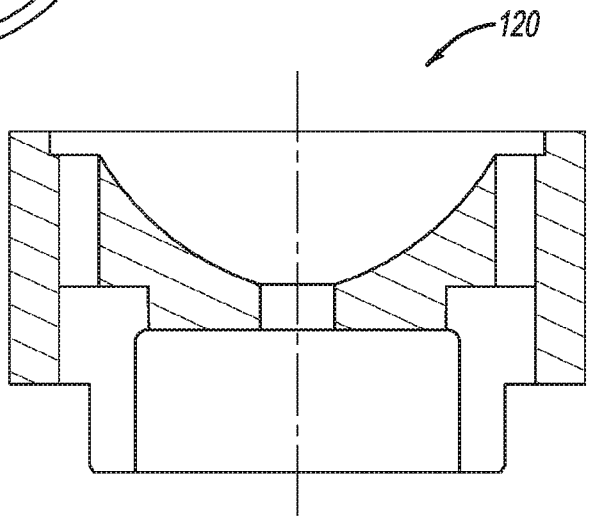
FIG. 10 is a cross-sectional view taken through section lines 10-10 in FIG. 9.
Figure 11:
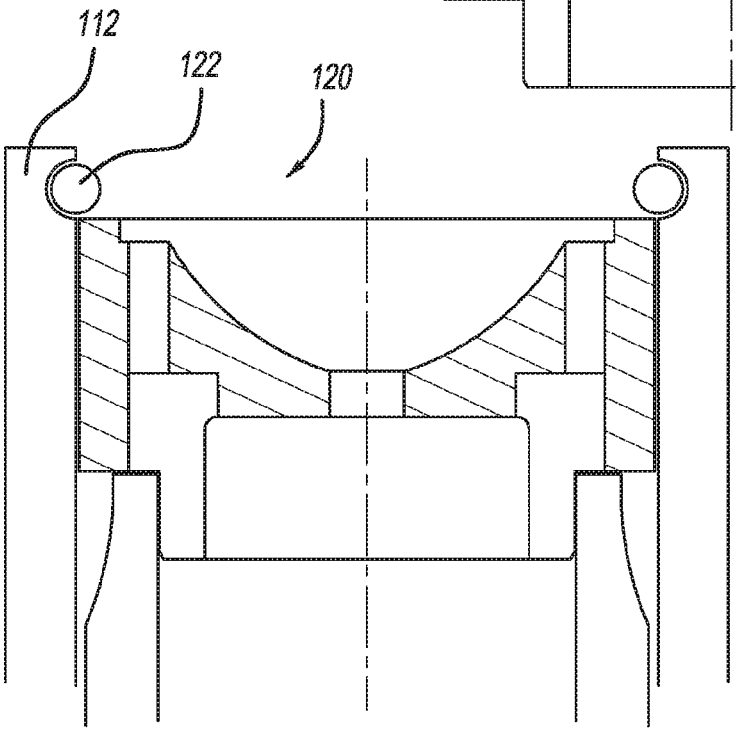
FIG. 11 is the cross-sectional view of FIG. 10 and shown retained within a body with a C-clip according to other features.

FIGS. 9-11 illustrate an assembly 110 that includes a socket 120 received in a body 112. The socket 120 can include similar features as any of the sockets 20*a*, 20*b*, 20*c* and 20*d* described above. In the configuration shown in FIGS. 9-11, the body 112 extends up around the socket 120 and is retained with a C-clip 122. Other retention methods may be used. The same gravity feed features described above may be incorporated into the configuration shown in FIGS. 9-11.

The foregoing description of the aspects of the present teachings has been provided for purposes of illustration and description. It is not intended to be exhaustive or to limit the disclosure. Individual elements or features of a particular example are generally not limited to those particular aspects, but, where applicable, are interchangeable and can be used in a selected examples, even if not specifically shown or described. The same may also be varied in many ways. Such variations are not to be regarded as a departure from the disclosure, and all such modifications are intended to be included within the scope of the disclosure.

What is claimed is:

1. A hydraulic lash adjuster assembly comprising:
a bucket; and
a hydraulic lash adjuster received in the bucket and having;
a body;
a leakdown plunger received in the body; and
a socket received by the leakdown plunger, wherein socket comprises a top surface, a bottom surface and an intermediate shoulder surface, wherein the intermediate shoulder surface abuts the leakdown plunger, the socket and leakdown plunger defining a reservoir therebetween, wherein the socket includes a gravity feed arrangement to feed fluid to the reservoir of the leakdown plunger.

2. The hydraulic lash adjuster assembly of claim 1 wherein the gravity feed arrangement comprises at least one aperture defined through the socket.

3. The hydraulic lash adjuster assembly of claim 2 wherein the at least one aperture comprises a first pair of apertures that lead to a second pair of apertures, wherein the apertures of the second pair are offset from the apertures of the first pair.

4. The hydraulic lash adjuster assembly of claim 3 wherein the second pair of apertures provide a surface tension seal to a top surface of the leakdown plunger and route fluid into the reservoir.

5. The hydraulic lash adjuster assembly of claim 2, further comprising:
a push tube guide that encloses the socket within the bucket.

6. The hydraulic lash adjuster assembly of claim 1, wherein the leakdown plunger defines a recirculation passageway including an annular notch portion and an aperture portion.

7. The hydraulic lash adjuster assembly of claim 1 wherein the socket is enclosed in the bucket.

8. A hydraulic lash adjuster assembly comprising:
a bucket; and
a hydraulic lash adjuster received in the bucket and having;
a body;
a leakdown plunger received in the body; and
a socket assembly received by the leakdown plunger, the socket assembly and leakdown plunger defining a reservoir therebetween, wherein the socket assembly comprises:
a socket that includes a valve seat and a valve restraint; and
a valve member comprising a plate that moves relative to the socket, wherein the valve member engages the valve restraint in a first orientation and engages the valve seat in a second orientation, wherein fluid is permitted to flow between the valve member and the valve restraint in the first orientation and fluid is precluded from flowing between the valve member and the valve seat in the second orientation.

9. The hydraulic lash adjuster assembly of claim 8 wherein the valve member is captured in the socket by the valve restraint.

10. The hydraulic lash adjuster assembly of claim 9 wherein the valve restraint comprises a shelf.

11. The hydraulic lash adjuster assembly of claim 10 wherein the shelf is one of non-flat and irregular shaped.

12. The hydraulic lash adjuster assembly of claim 10 wherein the valve restraint comprises fingers.

13. The hydraulic lash adjuster of claim 12 wherein the fingers are radially offset relative to each other.

14. A hydraulic lash adjuster assembly comprising:
a bucket; and
a hydraulic lash adjuster received in the bucket and having;
a body;

a leakdown plunger received in the body, wherein the leakdown plunger defines a recirculation passageway including an annular notch portion and an aperture portion; and a socket received by the leakdown plunger, the socket and leakdown plunger defining a reservoir therebetween, wherein the socket includes a gravity feed arrangement to feed fluid to the reservoir of the leakdown plunger.

15. The hydraulic lash adjuster assembly of claim 14 wherein the socket comprises a top surface, a bottom surface and an intermediate shoulder surface.

16. The hydraulic lash adjuster assembly of claim 14 wherein the gravity feed arrangement comprises at least one aperture defined through the socket.

17. The hydraulic lash adjuster assembly of claim 16 wherein the at least one aperture comprises a first pair of apertures that lead to a second pair of apertures, wherein the apertures of the second pair are offset from the apertures of the first pair.

18. The hydraulic lash adjuster assembly of claim 17 wherein the second pair of apertures provide a surface tension seal to the top surface of the leakdown plunger and route fluid into the reservoir.

* * * * *